US008002267B2

(12) United States Patent
Iemura et al.

(10) Patent No.: US 8,002,267 B2
(45) Date of Patent: Aug. 23, 2011

(54) PAPER FEED APPARATUS

(75) Inventors: Hirotoshi Iemura, Nara (JP); Shinichiroh Hiraoka, Nara (JP); Makoto Masuda, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 746 days.

(21) Appl. No.: 11/517,446

(22) Filed: Sep. 8, 2006

(65) Prior Publication Data

US 2007/0057433 A1 Mar. 15, 2007

(30) Foreign Application Priority Data

Sep. 12, 2005 (JP) ..... 2005-263937

(51) Int. Cl.
*B65H 7/08* (2006.01)
*B65H 3/06* (2006.01)

(52) U.S. Cl. ..... 271/117; 271/110

(58) Field of Classification Search ..... 271/109, 271/110, 152, 153, 157, 160, 117
See application file for complete search history.

(56) References Cited

U.S. PATENT DOCUMENTS 5,219,156 A * 6/1993 Mori ..... 271/110
5,328,163 A * 7/1994 Yamada ..... 271/10.01
5,462,267 A * 10/1995 Hori ..... 271/10.04
5,951,002 A * 9/1999 Yokota ..... 271/117
6,260,839 B1 * 7/2001 Araki et al. ..... 271/10.11
6,293,539 B1 * 9/2001 Fukatsu et al. ..... 271/126
6,503,010 B2 * 1/2003 Jeong ..... 400/629
6,648,322 B2 * 11/2003 Park ..... 271/117
2005/0184447 A1 * 8/2005 Tsukamoto et al. ..... 271/109

FOREIGN PATENT DOCUMENTS

JP 60262739 * 12/1985
JP 5-132194 A 5/1993
JP 5-132196 A 5/1993
JP 8-282880 A 10/1996
JP 9-235033 A 9/1997
JP 11-79435 A 3/1999
JP 2000-289867 A 10/2000

* cited by examiner

*Primary Examiner* — Kaitlin S Joerger
*Assistant Examiner* — Patrick Cicchino
(74) *Attorney, Agent, or Firm* — Birch, Stewart, Kolasch & Birch, LLP

(57) ABSTRACT

An embodiment of a paper feed apparatus is provided with a pressure varying mechanism that varies a load pressure of a pickup roller to originals. The pressure varying mechanism has a rotating lever that switches the load pressure, a rotating arm that contacts and presses against a swinging arm of the pickup roller, and a biasing portion that biases the rotating arm to the swinging arm when the rotating arm contacts to the swinging arm. When continuously reading a wad of originals in which different-size originals are mixed, due to a user operating the rotating lever, the load pressure to the originals is increased by making the rotating arm contact to the swinging arm such that the swinging arm is pressed by the biasing portion.

12 Claims, 8 Drawing Sheets

PAPER FEED APPARATUS

CROSS REFERENCE TO RELATED APPLICATIONS

This application claims priority under 35 U.S.C. §119(a) on Patent Application No. 2005-263937 filed in Japan on Sep. 12, 2005, the entire contents of which are hereby incorporated by reference.

BACKGROUND OF THE INVENTION

1. Field of Invention

The present invention relates to paper feed apparatuses provided with a pickup roller that performs sheet-by-sheet feeding of originals which have been placed on an original placement tray.

2. Related Art

In conventional image forming apparatuses provided with original reading apparatuses, continuous reading of wads of different-size originals is prohibited. That is to say, it is prohibited to place wads of originals including different-size originals on an original placement tray. This is in order to prevent diagonal paper feeding by the pickup roller due to continuous paper feeding by the pickup roller of different-size originals.

And in order to very reliably prevent occurrences of diagonal paper feeding, in recent image forming apparatuses, as shown in FIG. 8, an original placement tray 201 is constructed so that originals are placed at a center reference L0 in the tray-width direction. That is, a pair of paper pressing plates 202, 202 is arranged on left and right sides perpendicular to a paper transport direction X and these paper pressing plates 202, 202 can be moved closer or farther from each other by a rack-and-pinion 203. This ensures that the paper pressing plates 202, 202 always move to equivalent lateral positions with respect to the center reference L0. For this reason, when the paper pressing plates 202, 202 are moved to align with the width size of the papers to be placed, a width-direction center position of the papers to be placed here is always made to match the center reference L0 of the original placement tray 201. Thus, regardless of the size of the originals placed on the original placement tray 201, the originals that are placed are placed in such a manner that the center reference L0 always becomes the width-direction center position.

On the other hand, a pickup roller 210 and a separation roller 211 are arranged so as to have lateral symmetry with respect to the position of the center reference L0. Thus, regardless of the size of the originals placed on the original placement tray 201, the pickup roller 210 can perform stable feeding of originals by making contact therewith with an equivalent lateral-direction width from the width-direction center position of the originals that have been placed, and therefore the possibility of diagonal paper feeding occurring is low.

In this regard, along with the advancement of developments in high-speed image forming apparatuses in recent years, "same-time reading of different-size originals" has come to be allowed while providing a predetermined condition. Here, "predetermined condition" is a limit in mixed type originals of a small size original being an original size one rank smaller than a large size original. Specifically, these are combinations such as A3 with B4, A4 with B5, B5 with A5, and B4 (landscape) with A4 (portrait).

However, when paper feeding is carried out by placing wads of originals, in which different sizes are mixed, on the original placement tray 201 having the center reference L0, large size originals are pressed on their lateral edges by the paper pressing plates 202, 202 on the left and right and therefore are aligned with the center reference with respect to the pickup roller 210, but small size originals are usually placed with one edge thereof aligned with the large size originals and therefore are not positioned on the center reference with respect to the pickup roller 210. For this reason, the pickup roller 210 makes contact with the small size originals in a position displaced from the width-direction center position of the small size originals and therefore there is a problem of the likelihood of diagonal paper feeding since a laterally equivalent load is not applied to the small size originals. This may result in a range of problems such as tearing of the originals due to the originals impacting on an end face of a paper guide (omitted in drawings) in the transport path thereafter and defective image reading due to diagonal reading during reading the original.

Consequently, automatic paper feed apparatuses (for example, see JP H11-79435A (hereinafter referred to as "Patent Document 1")) and original transport apparatuses (for example, see JP H08-282880A (hereinafter referred to as "Patent Document 2")) have been proposed to address the problem of diagonal paper feeding (that is, diagonal transport).

The automatic paper feed apparatus described in Patent Document 1 is configured such that two assistive rollers are arranged on the sides in substantially equivalent positions to a feeding roller or on an upstream side of the feeding roller with respect to the paper feeding direction of the originals, and they sandwich the feeding roller in a direction perpendicular to the paper feeding direction. The assistive rollers are then rotated with no driving force being applied in the same direction as the feeding roller and apply pressure to the surface of the originals prior to the feeding roller landing on the surface of the originals.

Furthermore, the original transport apparatus described in Patent Document 2 is provided with a transport roller provided at a leading edge position of the originals that have been placed and a pressure roller, which is positioned on an upstream side of the transport roller and applies pressure to the originals during transport of the originals.

That is to say, in the configurations provided in Patent Documents 1 and 2, occurrences of diagonal movement are prevented by applying pressure to the originals more strongly using assistive rollers or a pressure roller during feeding of the originals or during transport of the originals.

However, in both of these apparatuses described in the conventional art, there is a necessity to arrange new roller members such as the assistive rollers and the pressure roller, and therefore there are problems in that there is a necessity to cordon locations for those arrangements and the structures become complicated structurally. Furthermore, neither of the apparatuses described in the conventional art give any consideration to continuous reading by placing wads of originals having different sizes on the original placement tray and accordingly have the problem of being configurations not suited to a case of reading wads of different-size originals.

SUMMARY OF THE INVENTION

The present invention has been devised to address these issues and it is an object thereof to provide a paper feed apparatus capable of reliably preventing diagonal paper feeding of different-size originals (particularly small size originals) by providing means for applying further load pressure to a pickup roller itself in addition to the conventional load pressure of the pickup roller when a wad of different-size originals is placed on an original placement tray and fed.

A paper feed apparatus of the present invention comprises a pickup roller that performs sheet-by-sheet feeding of originals placed on an original placement tray, and a pressure varying mechanism that varies a load pressure of the pickup roller to the originals. Here, the configuration may be such that the pressure varying mechanism comprises a switching member that switches a load pressure and the load pressure to the originals is varied by a user operating the switching member. That is, the configuration may be such that, due to a manual operation by the user, the load pressure of the pickup roller is varied (specifically, the load pressure is increased). By using this manual operation, the configuration can be simplified. In this case, the pressure varying mechanism comprises a pressing portion that contacts and presses against a support shaft of the pickup roller, and a biasing portion that biases the pressing portion toward the support shaft when the pressing portion makes contact to the support shaft, wherein the load pressure to the originals is increased by bringing the pressing portion in contact with the support shaft and by letting the biasing portion press the pressing portion against the support shaft when a user has operated the switching member. Here, an elastic structure such as a coil spring can be used as the biasing portion.

Furthermore, the paper feed apparatus of the present invention may be configured provided with a different size mode in which a wad of originals having different original sizes is read, wherein the pressure varying mechanism varies the load pressure when the different size mode is selected. That is, the configuration may be such that the load pressure is varied automatically based on a selection operation involving selection of the different size mode.

In this case, the configuration may be such that the pressure varying mechanism comprises a pressing portion that contacts and presses against a support shaft of the pickup roller, a control portion that performs drive control of the pressing portion, and a biasing portion that biases the pressing portion toward the support shaft when the pressing portion makes contact to the support shaft, wherein the pressure varying mechanism increases the load pressure to the originals by drive-controlling the pressing portion to contact to the support shaft using the control portion and by letting the biasing portion press the pressing portion against the support shaft when the different size mode is selected.

It should be noted that an increase of the load pressure is set to within a range of three to ten times a load pressure prior to increasing the load pressure. Ordinarily, the force applied by pressure of the actuator driving the pickup roller is approximately 1 g, and therefore the load pressure when increased is within a range of 3 to 10 g, or more preferably 5 to 7 g.

It should be noted that in the paper feed apparatus of the present invention, the original placement tray is constructed such that originals are placed on a center reference in a tray-width direction, and the pickup roller is arranged in opposition to the center reference position. Furthermore, a condition of different-size originals included in a wad of originals is that a width-direction size is up to one rank different in size than a specified size. When the difference in size is greater than this, there is a possibility that small size originals cannot be picked up sufficiently by the pickup roller and therefore the setting is up to one rank size from the specified size in view of safety. Furthermore, the original placement tray is not limited to a center reference construction and the present invention can also be applied to a construction of a one side reference, which are often employed in conventional image forming apparatuses (that is, a back side (line L11 shown in FIG. 8) reference or a front side (line L12 shown in FIG. 8) reference as viewed from a front position (a position where the user stands) of the image forming apparatus).

With a thus-configured paper feed apparatus, there is no occurrences of diagonal paper feeding of originals and different-size originals can be fed smoothly in succession even when a wad of different-size originals is placed on the original placement tray for continuous reading. In this case, by using a mechanical structure that further increases the load pressure of the pickup roller, the load pressure to the originals can be increased during paper feeding using a simple structure without adding new roller members.

DESCRIPTION OF THE PREFERRED EMBODIMENTS

Hereinafter, embodiments of the present invention are described with reference to the accompanying drawings.

—Overall Description of Image Forming Apparatus—

Figure 1:
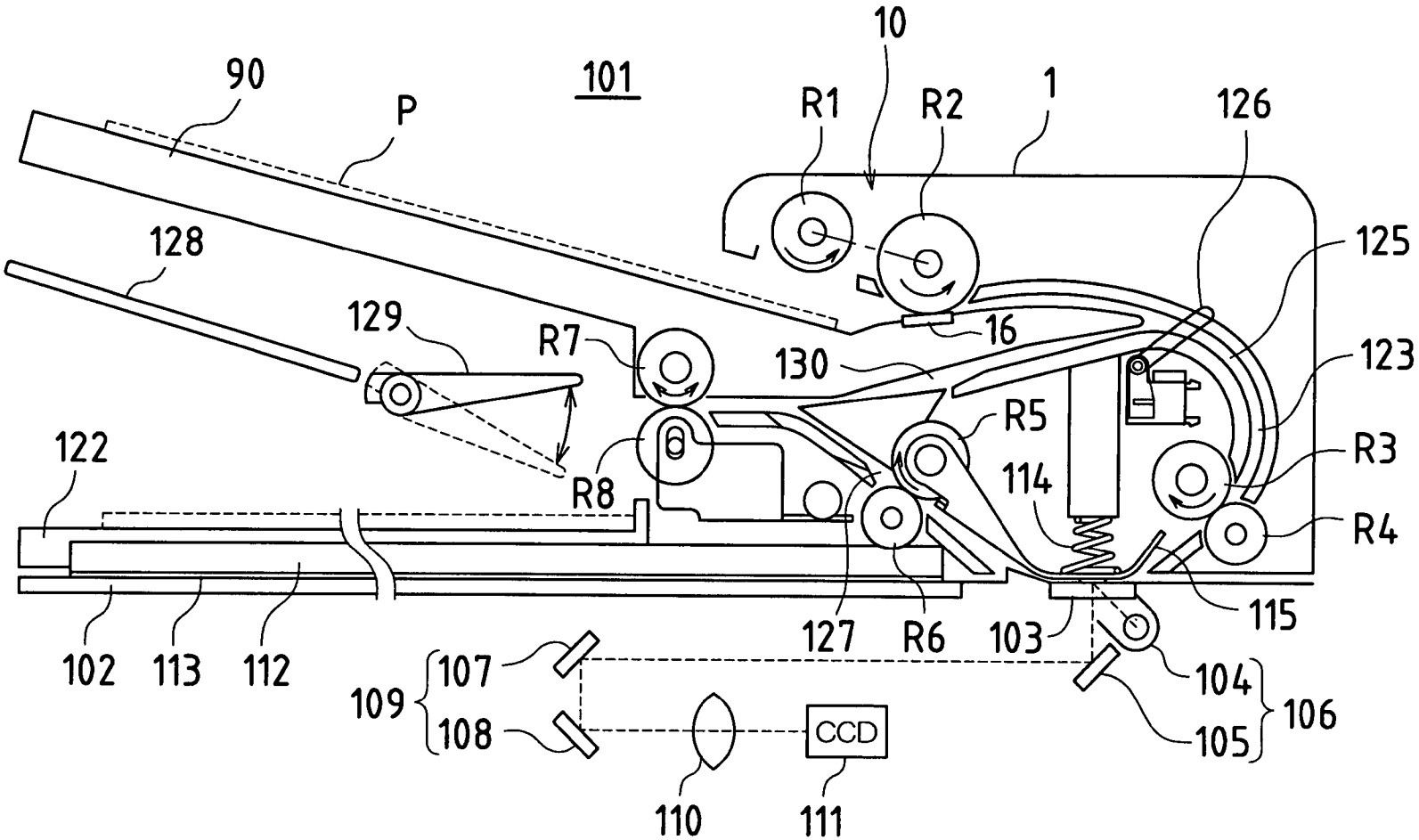
FIG. 1 is a cross-sectional view of an original reading apparatus provided with a paper feed apparatus according to the present invention.

FIG. 1 is a cross-sectional view of an original reading apparatus 101 provided with a paper feed apparatus according to an embodiment of the present invention. First, referring to FIG. 1, simple description is given of the overall structure of the original reading apparatus 101.

The original reading apparatus 101 is capable of reading an original P that has been placed on an original stage 102 and is in a stationary state, and is also capable of reading the original P while the original P is being transported over another original stage 103. In order to achieve such reading, a light source unit 106 constituted by a light source 104 and a mirror 105, a mirror unit 109 constituted by mirrors 107 and 108, an imaging lens 110, and a CCD reading unit 111 are provided below the original stages 102 and 103.

When performing stationary reading using the original stage 102, the optical path length to the CCD reading unit 111 is kept constant and an image of an entire surface of the original is read by having the light source unit 106 perform a scanning movement at a velocity V and the mirror unit 109 perform a scanning movement at a velocity V/2 below the original stage 102. And when performing moving reading using the original stage 103, an image of an entire surface of the original is read by making the light source unit 106 come to a standstill below the original stage 103 and transporting the original in a manner to be described below. Furthermore, an original pressing plate 113 that is provided on a rear surface of an original cover 112 is arranged facing the original stage 102 and an original pressing plate 115 that is biased toward the original stage 103 with a biasing spring 114 is arranged facing the original stage 103.

Broadly divided, a sheet transport mechanism in the original reading apparatus 101 is constituted by an original placement tray 90 arranged relatively above, an original discharge tray 122 arranged below the original placement tray 90, and a curved transport path 123 that connects between these.

The originals P placed on the original placement tray 90 are taken out by a pickup roller R1 of a paper feed apparatus 10, which is described in detail below, then separated sheet by sheet by a separation roller R2 and a separation plate 16, and transported to a main transport path 125 forming the curved transport path 123. After the transport of an original has been confirmed by an original insertion sensor 126, the transported original is transported to an original reading portion of the original stage 103 via a drive roller R3, which is a timing roller (PS roller) that aligns a leading edge of a diagonally moved original and dispatches the original with a prescribed image reading timing, and an idler roller R4 that forms a pair with this, such that reading of an image of the original is carried out.

An original for which reading has been completed is withdrawn from the reading portion by a pair of transport rollers R5 and R6, and discharged by way of a discharge path 127 onto the original discharge tray 122 by a pair of discharge rollers R7 and R8 that are capable of reverse rotation.

Furthermore, in the original reading apparatus 101, an intermediate tray 128 is arranged between the original placement tray 90 and the original discharge tray 122, and a swinging plate 129 is arranged facing the discharge rollers R7 and R8. As shown by the solid line in FIG. 1, when the swinging plate 129 is raised upwardly, originals discharged by the discharge rollers R7 and R8 are discharged onto the original discharge tray 122. And as shown by the dashed line, when the swinging plate 129 inclines downward, the originals discharged by the discharge rollers R7 and R8 are scooped up by the swinging plate 129 and discharged onto the intermediate tray 128.

The intermediate tray 128 and the swinging plate 129 are provided to enable the reading of both the front and reverse sides of the originals, and an original transported in the discharge path 127 and discharged by the discharge rollers R7 and R8 is discharged onto the intermediate tray 128, then held standstill sandwiched by its trailing edge between the discharge rollers R7 and R8. After this, the original is led to enter a sub transport path 130 by the discharge rollers R7 and R8 rotating in reverse, then converged to the curved transport path 123 from the sub transport path 130. In this way, first an image of the upper surface of the original that is placed on the original placement tray 90 is read, then an image of the rear surface of the original is read by performing switchback transport by way of the discharge path 127, the discharge rollers R7 and R8, the swinging plate 129, the intermediate tray 128 and the sub transport path 130.

Figure 8:
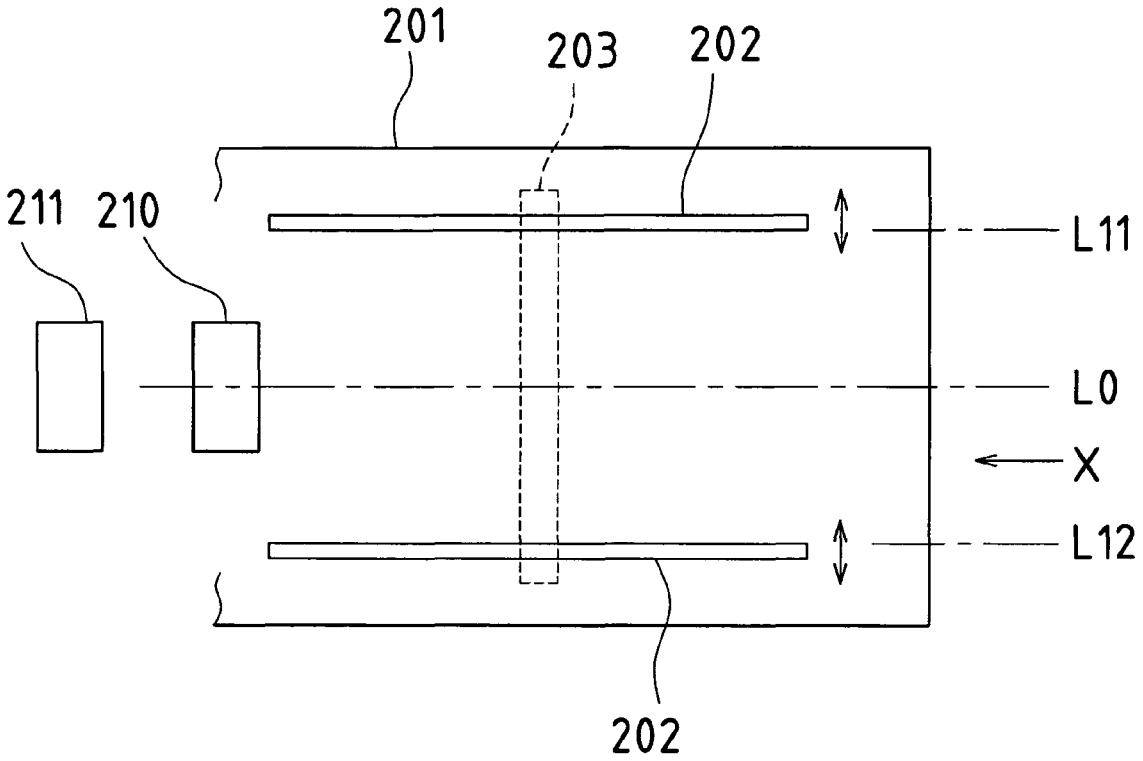
FIG.8 Conventional Art
FIG. 8 is an explanatory diagram showing a configuration of a center reference original placement tray.

It should be noted that in the original reading apparatus 101 of the above-described configuration, the structure of the original placement tray 90 is similar to the original placement tray 201 shown in FIG. 8, and also similar to the case of the original placement tray 201 shown in FIG. 8, the arrangement positions of the pickup roller R1 and the separation roller R2 of the paper feed apparatus 10 are arranged so that there is lateral symmetry with respect to the center reference L0 position.

—Description of Fundamental Structure and Fundamental Operation of Paper Feed Apparatus 10—

Next, the fundamental structure and fundamental operation of the paper feed apparatus 10 according to the present embodiment are described with reference to the schematic cross-sectional views of the paper feed apparatus shown in FIGS. 2 and 3.

In an outer case 1 that accommodates the pickup roller R1 and the separation roller R2, the separation roller R2 is rotatably supported by a support pin 5 arranged in a direction perpendicular to a transport direction X, and one end of a swinging arm 6 is supported so as to be capable of swinging displacement by the support pin 5. Furthermore, the pickup roller R1 is rotatably supported by a support pin 7 arranged in a direction perpendicular to the transport direction X at the other end of the swinging arm 6.

Figure 4:
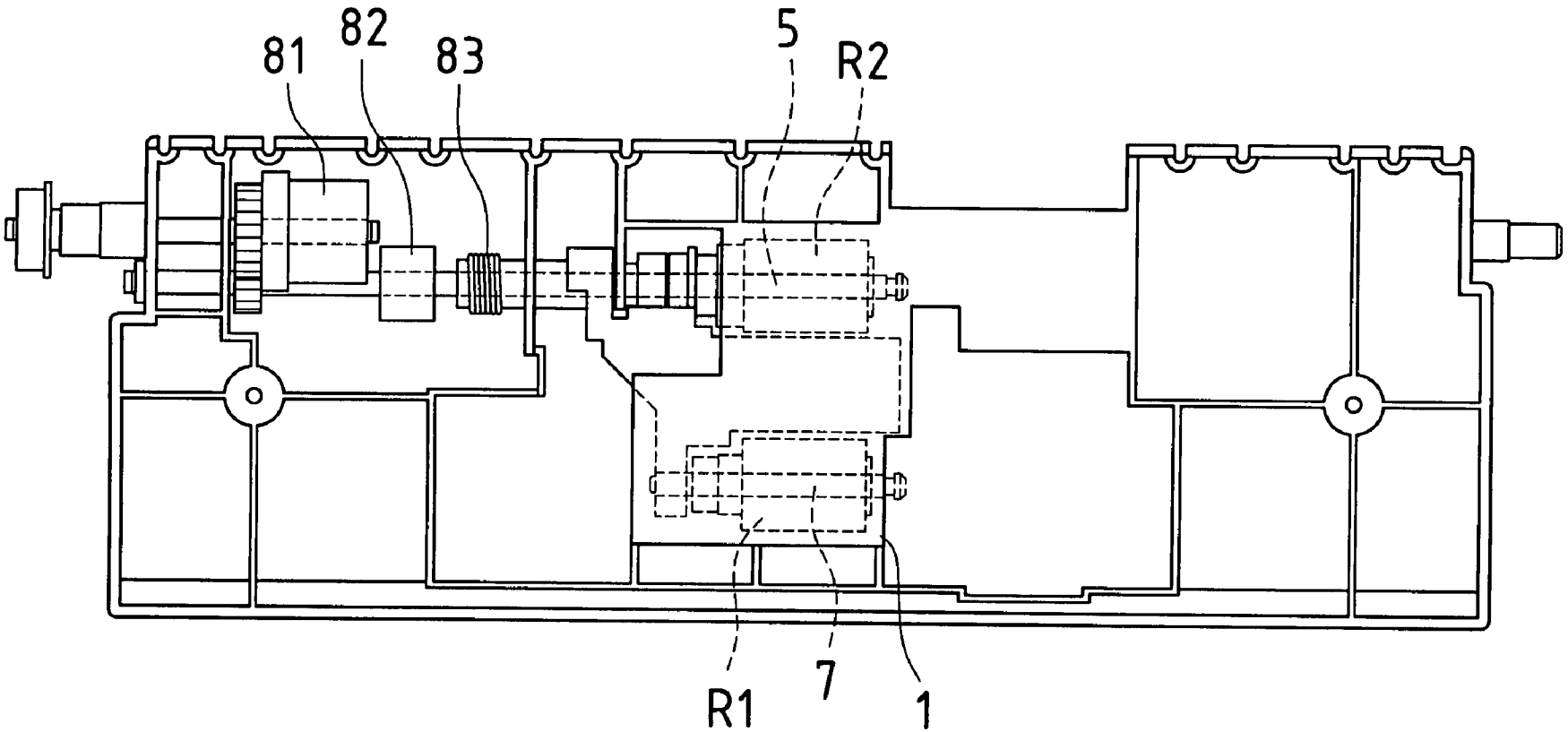
FIG. 4 is a schematic plan view of an outer case including the paper feed apparatus of the present invention.

FIG. 4 is a schematic plan view of the outer case 1 including the paper feed apparatus 10 of the above-described configuration.

In this paper feed apparatus 10, the swinging arm 6 that has the pickup roller R1 and the separation roller R2 is provided substantially in a central area in the width direction of the outer case 1. Furthermore, a drive control means for driving swinging displacement of the swinging arm 6 is provided at one side of the swinging arm 6 and the drive control means is constituted mainly by an electromagnetic clutch 81, a torque limiter 82, and a swinging arm spring 83. That is, disconnection and connection of drive is carried out by the electromagnetic clutch 81 and the driving of the swinging displacement of the swinging arm 6 is carried out using the force of the torque limiter 82. Furthermore, the swinging arm spring 83 constantly applies a biasing force to the swinging arm 6 in an elevation direction, and when the force of the torque limiter 82 is not being exerted, the swinging arm 6 is configured to rise to a predetermined position inside the outer case 1 due to the biasing force of the swinging arm spring 83.

Figure 2:
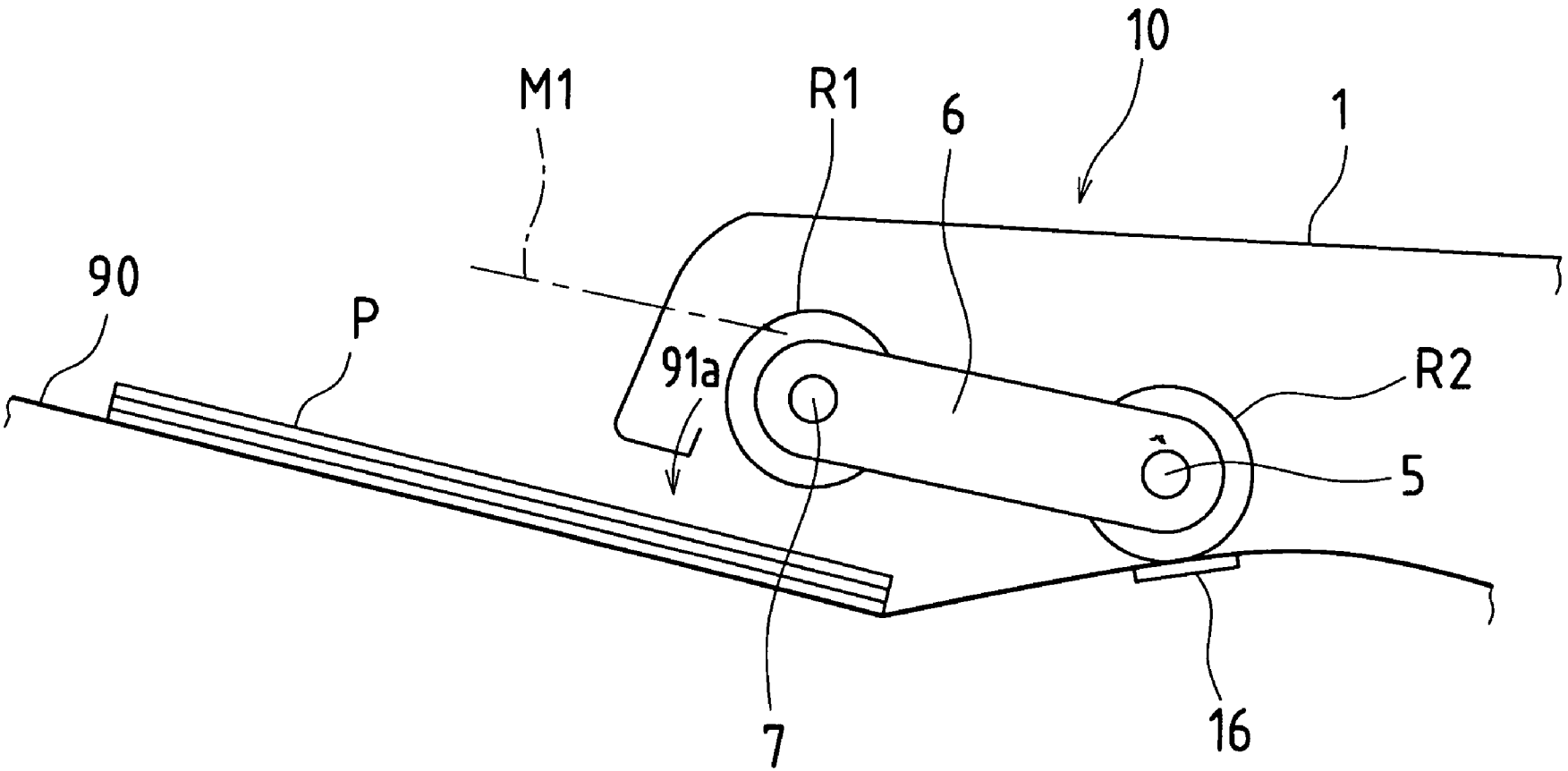
FIG. 2 is a schematic cross-sectional view of the paper feed apparatus of the present invention.
Figure 3:
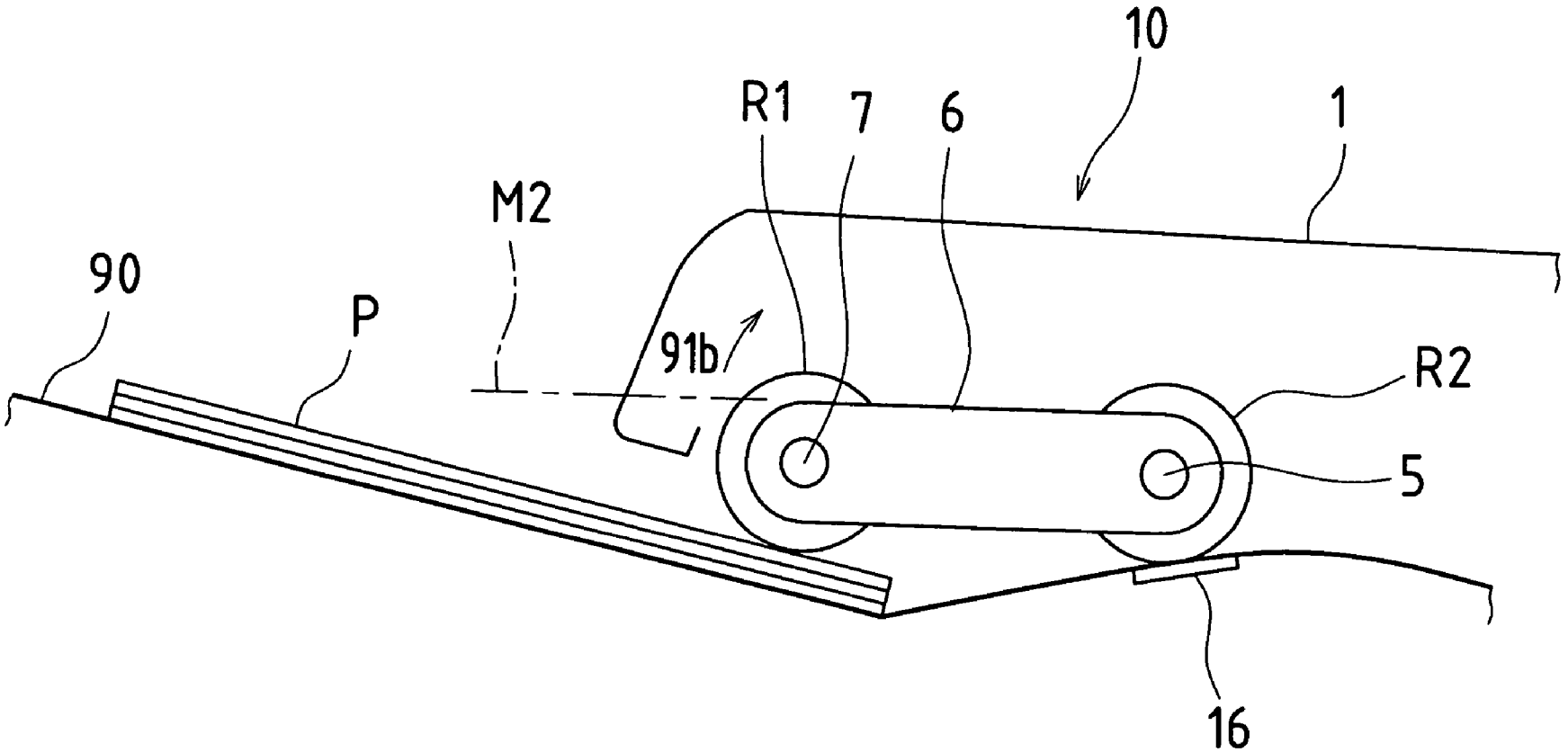
FIG. 3 is a schematic cross-sectional view of the paper feed apparatus of the present invention.

Then, when reading of an original commences from a state shown in FIG. 2, the swinging arm 6 is caused to swing downward as indicated by the arrow 91*a* by the drive control means and, as shown in FIG. 3, the pickup roller R1 contacts the uppermost surface of the originals P with a fixed pressure, thereby feeding the original of the uppermost surface. Then, when the leading edge of the uppermost surface original reaches the separation roller R2, the swinging arm 6 is caused to swing upward as indicated by the arrow 91*b* and the pickup roller R1 moves apart from the original P as shown in FIG. 2. During the reading of originals, the paper feed apparatus successively feeds the wad of originals placed on the original placement tray 90 while repeating the swinging operation shown in FIGS. 2 and 3.

The foregoing has been a description of the fundamental structure and fundamental operation of the paper feed apparatus 10.

—Description of Paper Feed Apparatus 10 of Present Embodiment—

Embodiment 1

Figure 5:
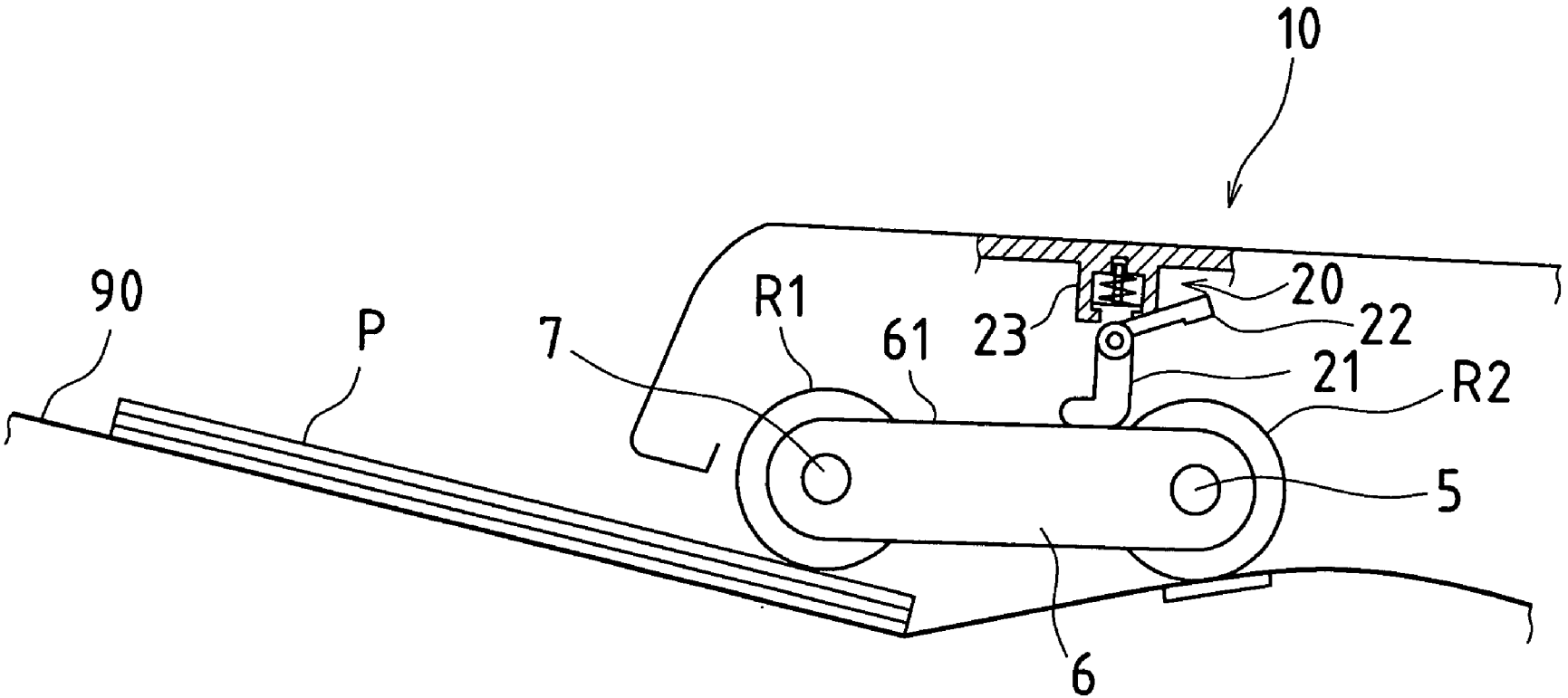
FIG. 5 is a schematic cross-sectional view showing a structure of a paper feed apparatus of embodiment 1.

FIG. 5 shows an enlargement of the structure of the paper feed apparatus 10 portion according to embodiment 1, which is devised to enable prevention of diagonal paper feeding even when carrying out continuous reading of wads of different-size originals placed on the original placement tray 90. Note however that a predetermined condition also applies in embodiment 1 to different-size originals and the small size original is set as a size up to one rank smaller in the transport width direction than the large size original of mixed originals having different sizes.

With the paper feed apparatus 10 of embodiment 1, the load pressure to the original P by the pickup roller R1 is switchable between when a wad of same-size originals lined up in the same direction is being fed continuously and when a wad of originals, in which different-size originals are mixed having different sizes in the width direction, is fed continuously, and the load pressure is slightly increased when a wad of different-size originals is being fed continuously compared to when a wad of same-size originals is being fed continuously.

To describe this more specifically, in addition to the fundamental structure shown in FIGS. 2 and 3, the paper feed apparatus 10 of embodiment 1 is provided with a pressure varying mechanism 20 that increases the load pressure of the pickup roller R1 onto the originals when a wad of different-size originals is placed on the original placement tray 90 and fed continuously.

Figure 6A:
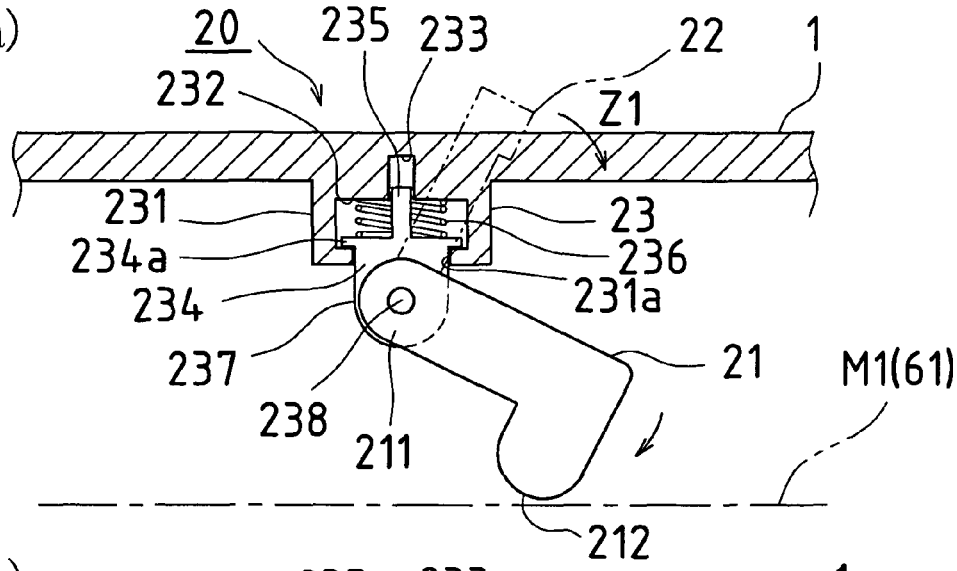
FIGS. 6(*a*) to 6(*c*) are explanatory diagrams showing enlargements of a portion of a pressure varying mechanism.
Figure 6B:
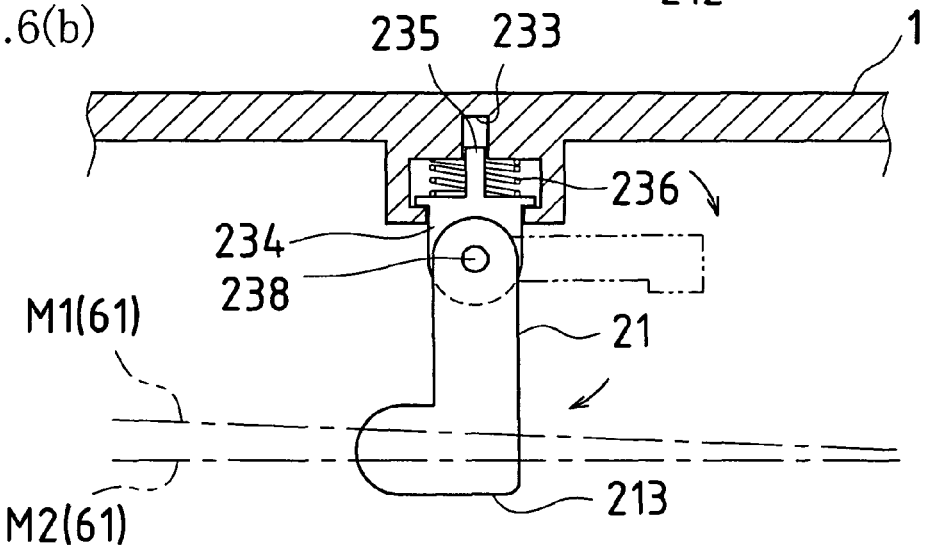
Figure 6C:
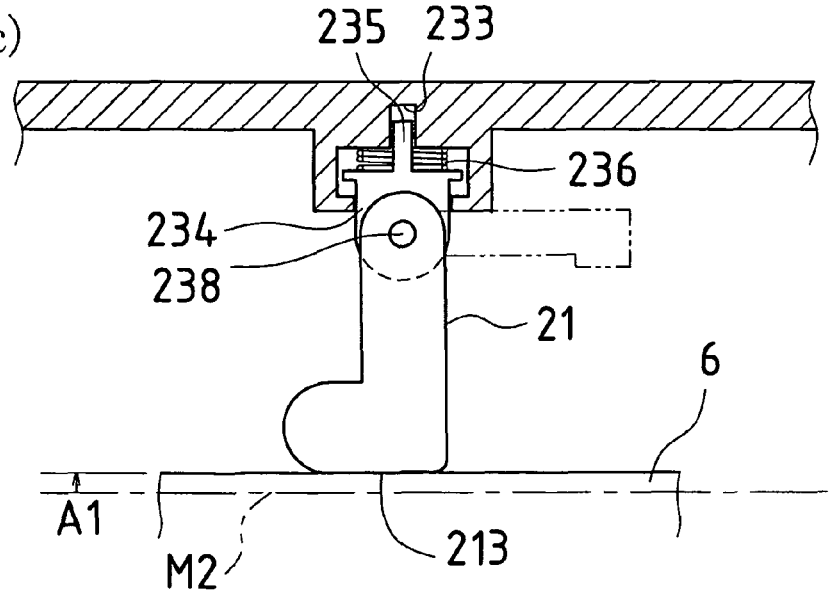

FIGS. 6(*a*) to 6(*c*) show enlargements of the pressure varying mechanism 20 portion.

The pressure varying mechanism 20 is provided with a rotating arm ("pressing portion" in the claims) 21 for contacting from above and pressing against an upper edge 61 of the swinging arm ("support shaft" in the claims) 6, a rotating lever ("switching member" in the claims) 22 that enables a manual rotation operation of the rotating arm 21, and a biasing portion 23 that downwardly biases the rotating arm 21 against the swinging arm 6 when the rotating arm 21 contacts the swinging arm 6.

The biasing portion 23 is provided inside a tube shaped support structure 231 formed on a lower surface of the outer case 1. That is, a sliding structure 234 that slides vertically inside the support structure 231 is held within the support structure 231 and a sliding rod 235 that projects upwardly is formed at an upper surface central area of the sliding structure 234. On the other hand, at an inner area upper surface 232 of the support structure 231 is formed a hole for sliding movement 233, which holds the sliding rod 235 so as to enable vertical sliding movement thereof with the sliding rod 235 inserted in a central area thereof. Furthermore, a coil spring 236 having a form for insertion into the sliding rod 235 is mounted in a compressed state between the inner area upper surface 232 of the support structure 231 and an upper surface of the sliding structure 234. That is, the sliding structure 234 is constantly subjected to a biasing force inside the support structure 231 such that it is pushed downward due to the biasing force (elastic force) of the coil spring 236. A flange shaped stopping piece 234*a* is formed at an upper edge perimeter portion of the sliding structure 234, which prevents this from falling out of the support structure 231 by the stopping piece 234*a* coming into contact with a perimeter portion upper edge of an aperture portion 231 a formed on a lower surface of the support structure 231.

On the other hand, a lower surface side of the sliding structure 234 is formed so as to project downward from the aperture portion 231*a* of the support structure 231 and an upper end portion 211 of the rotating arm 21 is rotatably supported through a rotating shaft 238 on this projection portion 237. Furthermore, the rotating lever 22 (shown by a dashed double-dotted line in FIGS. 6(*a*) to 6(*c*)), which is provided extending in a direction substantially perpendicular to the rotating arm 21, is integrally provided at the upper end portion 211 of the rotating arm 21. Due to manual operation of the rotating lever 22 by a user, the rotating arm 21 is configured to rotationally move between two positions, one of these being a released position as shown in FIG. 6(*a*) and the other being a position pressing on the swinging arm 6 as shown in FIG. 6(*b*) and FIG. 6(*c*).

That is, in the state shown in FIG. 6(*a*), the rotating arm 21 is in a raised up state and a leading edge portion 212 of the rotating arm 21 is positioned at a position further above than a position M1 when the upper edge 61 of the swinging arm 6 has swung highest. That is, the paper feeding operation of the paper feed apparatus 10 in this state is the same as the fundamental operation described in FIGS. 2 and 3 (that is, the operation when feeding a wad of same-size originals).

On the other hand, when the rotating lever 22 is pushed down in a Z1 direction from the state shown in FIG. 6(*a*) to the state shown in FIG. 6(*b*), the rotating arm 21 rotates linked to this from the raised up state to a downwardly dropping state. Then, a lower end portion 213 of the rotating arm 21 at this time is positioned further lower than a position (a position when an original is being fed by the pickup roller) M2 of when the upper edge 61 of the swinging arm 6 has swung lowest. In fact, in this case, as shown in FIG. 6(*c*), the rotating arm 21 is pressed upwardly by the swinging arm 6 (a state pushed up by the amount indicated by A1 in the drawing). In this way, when the swinging arm 6 repeats a paper feeding operation as shown in FIGS. 2 and 3, the rotating arm 21 also slides up and down linked to the swinging operation and a load pressure is constantly applied downwardly on the swinging arm 6 by the biasing force of the compressed coil spring 236. That is, the paper feeding operation of the paper feed apparatus 10 in this state is an operation of when a wad of different-size originals that is allowable in the present invention is fed continuously.

Here, the load pressure applied to the swinging arm 6 by the coil spring 236 is set within a range of three to ten times the load pressure applied to the swinging arm 6 in the state shown in FIG. 6(*a*) in which the coil spring 236 is not exerting an influence. Ordinarily, the pressure applied by the own weight of the actuator driving the pickup roller R1 is approximately 1 g, and therefore the load pressure applied to the original by the pickup roller R1 with the addition of the load pressure of the coil spring 236 is within a range of 3 to 10 g. However, this is more preferably in the range of 5 to 7 g. As a result of carrying out paper feeding operation tests on a wad of different-size originals with an increase of load pressure at 3 to 10 g, the present inventors have confirmed absolutely no occurrences of diagonal paper feeding.

It should be noted that in FIG. 5 and FIGS. 6(*a*) to 6(*c*), it appears that the rotating lever 22 sinks into the outer case 1, but in fact an open window or the like for operation is provided in the outer case 1 and the user can achieve operation through the open window. Furthermore, the linking of the rotating lever 22 and the rotating arm 21 is omitted in the drawings, but a linking rod that projects in a lateral direction is formed at the upper end portion 211 of the rotating arm 21 and an anchor portion side of the rotating lever 22 is linked to this linking rod. This ensures that the rotating lever 22 does not interfere with vertical operation of the rotating arm 21 (that is, that the rotating lever 22 does not impact against the support structure 231).

Embodiment 2

Embodiment 1 was configured such that switching between a normal paper feeding operation when a wad of same-size originals is read continuously and a paper feeding operation of different-size originals when a wad of different-size originals is read continuously was carried out in a manual operation by the user, but embodiment 2 is configured such that this switching is carried out automatically. That is, this is configured such that a selection screen of reading operation modes is displayed on a control panel portion of an apparatus main body not shown in the drawings. That is, a same size mode in which a wad of same-size originals is read continuously and a different size mode in which a wad of different-size originals is read continuously are displayed, thereby allowing selection by the user. Here, when the user selects the different size mode, a system control portion not shown in the drawings that provides overall control of the image forming apparatus causes a rotation operation in which, for example, the rotating lever 22 or the rotating arm 21 shown in FIGS. 6(*a*) to 6(*c*) changes from the state shown in FIG. 6(*a*) to the state shown in FIG. 6(*b*).

A monostable type (or a bistable type) keep solenoid can be used for example as a rotation control method in this case. A conventional commonly known keep solenoid is used and therefore detailed description is omitted here, but this involves having a plunger attach to a permanent magnet arranged nearby due to the application of a momentary current after which this attached state is kept even after the electric current is stopped. On the other hand, the attachment of this state can be released by momentary application of reverse current. By using a keep solenoid such as this, power consumption during device operation can be reduced. Embodiment 2 can be configured such that the plunger of the keep solenoid is linked with the rotating lever 22 or the rotating arm 21, and the plunger is made to attach to the permanent magnet by application of a momentary current to the keep solenoid under the control of the system control portion, then the rotating lever 22 or the rotating arm 21 can be made to undergo a rotation operation by linking with the attachment operation of the plunger at this time.

It should be noted that a monostable type keep solenoid is used in embodiment 2, but there is no limitation whatsoever to a keep solenoid and an ordinary solenoid may be used.

Also note that the rotating arm 21 is used as a member for pressing the swinging arm 6 in embodiment 2, but it is not absolutely necessary to cause a rotation operation. For example, instead of the rotating arm 21, a vertical arm 31 that moves only vertically may be used when there is sufficient space between the swinging arm 6 and the outer case 1 as well as above the outer case 1.

Figure 7A:
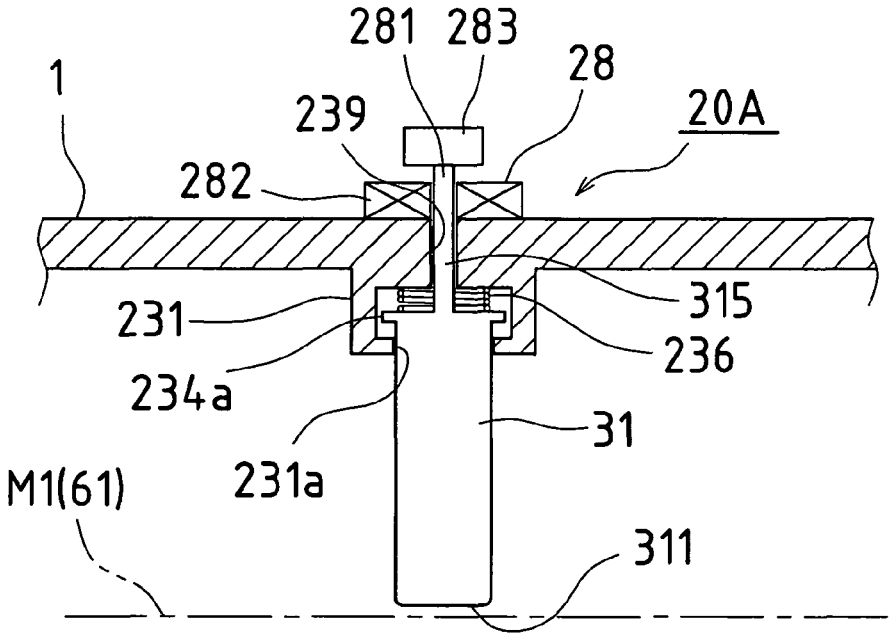
FIGS. 7(*a*) and 7(*b*) are explanatory diagrams showing another working example of a pressure varying mechanism.
Figure 7B:
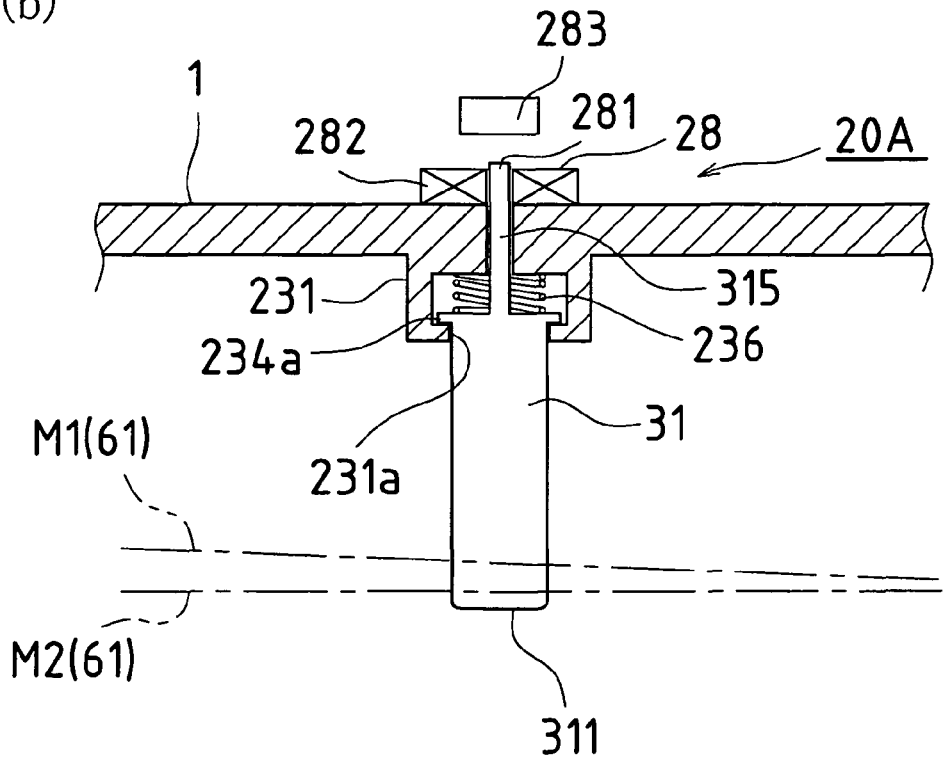

FIGS. 7(*a*) and 7(*b*) show, as another working example of the pressure varying mechanism, a pressure varying mechanism 20A using the vertical arm 31.

The following two points are the differences between the pressure varying mechanism 20A shown in FIGS. 7(*a*) and 7(*b*) and the pressure varying mechanism 20 shown in FIGS. 6(*a*) and 6(*b*). The first point is that the vertical arm 31 is formed such that the sliding structure 234 and the rotating arm 21 shown in FIGS. 6(*a*) to 6(*c*) are integrated in the state shown in FIG. 6(*b*). The second point is that a sliding rod 315 formed at an upper surface central area of the vertical arm 31 passes through a pass-through hole 239 formed in the outer case 1 and an upper end portion thereof is integrated with a plunger 281 of a keep solenoid 28. Other areas of the configuration are the same as the configuration shown in FIGS. 6(*a*) to 6(*c*), and therefore the same numerical symbols are used here with same components and detailed description thereof is omitted.

The pressure varying mechanism 20A of the present working example is configured such that an electromagnetic coil 282 is arranged around the pass-through hole 239 formed in the outer case 1 and the plunger 281, which is integrated with the sliding rod 315 of the vertical arm 31, inserts through a central area thereof and a permanent magnet 283 is arranged on a leading edge portion of the plunger 281.

With this configuration, when a wad of same-size originals is read continuously, the plunger 281 is kept attached to the permanent magnet 283 as shown in FIG. 7(*a*) due to the application of a momentary current to the keep solenoid 28. This positions a lower end portion 311 of the vertical arm 31 further above the position M1 of when the swinging arm 6 has swung highest, and therefore no load is applied to the swinging arm 6. On the other hand, when a wad of different-size originals is read continuously, the attachment is released by a momentary application of reverse current to the keep solenoid 28. As shown in FIG. 7(*b*), this makes the vertical arm 31 drop vertically downward due to the biasing force of the coil spring 236. Then, the lower end portion 311 of the vertical arm 31 at this time is positioned further lower than the position (a position when an original is being fed by the pickup roller) M2 of when the swinging arm 6 has swung lowest. In fact, in this case, the vertical arm 31 is pressed upwardly by the swinging arm 6. In this way, when the swinging arm 6 repeats a paper feeding operation as shown in FIGS. 2 and 3, the vertical arm 31 also slides up and down linked to the swinging operation and a load pressure is constantly applied downwardly on the swinging arm 6 by the biasing force of the compressed coil spring 236.

The present invention can be embodied and practiced in other different forms without departing from the gist and essential characteristics thereof. Therefore, the above-described working examples are considered in all respects as illustrative and not restrictive. The scope of the invention is indicated by the appended claims rather than by the foregoing description. All variations and modifications falling within the equivalency range of the appended claims are intended to be embraced therein.

What is claimed is:

1. A paper feed apparatus comprising:

a pickup roller that performs sheet-by-sheet feeding of originals placed on an original placement tray, the pickup roller located above a location of the originals;

a support shaft extending from the pickup roller; and a pressure varying mechanism that varies a load pressure of the pickup roller to the originals, wherein the pressure varying mechanism is located above the pickup roller and the support shaft and includes a pressing unit, wherein the pressing portion includes a first position that contacts and directly presses against the support shaft and a second position which the pressing unit is in a released position so that the pressing unit does not contact the support shaft, the pressure varying mechanism varies the load pressure of the pickup roller to the originals by applying downward pressure on the support shaft so that the pickup roller applies downward pressure on the originals, the pressure varying mechanism applies the downward pressure on the support shaft by the pressing unit contacting and pressing against the support shaft, a same size mode in which a wad of originals having only a same original size is fed continuously and a different size mode in which a wad of originals having different original sizes is fed continuously are selectable, and the pressure varying mechanism increases the load pressure when the different size mode is selected.

2. The paper feed apparatus according to claim 1, wherein the pressure varying mechanism comprises a switching member that switches a load pressure and the load pressure to the originals is varied by a user operating the switching member.

3. The paper feed apparatus according to claim 2, wherein the pressure varying mechanism comprises:

a biasing portion that biases the pressing unit toward the support shaft when the pressing unit makes contact to the support shaft, wherein the pressure varying mechanism varies the load pressure so that the load pressure to the originals is increased by bringing the pressing unit in contact with the support shaft and by letting the biasing portion press the support shaft when a user has operated the switching member.

4. The paper feed apparatus according to claim 1, wherein the pressure varying mechanism varies the load pressure when a wad of originals including different-size originals has been placed on the original placement tray.

5. The paper feed apparatus according to claim 1, wherein the pressure varying mechanism comprises:

a control portion that performs drive control of the pressing unit, and a biasing portion that biases the pressing unit toward the support shaft when the pressing unit makes contact to the support shaft, wherein the pressure varying mechanism varies the load pressure so that the load pressure to the originals is increased by drive-controlling the pressing unit to contact to the support shaft and by pressing the support shaft with the biasing portion when the different size mode is selected.

6. The paper feed apparatus according to claim 3, wherein an increase of the load pressure is within a range of three to ten times a load pressure prior to increasing the load pressure.

7. The paper feed apparatus according to claim 4, wherein the original placement tray is constructed such that originals are placed on a center reference in a tray-width direction, the pickup roller is constructed so as to be arranged in opposition to the center reference position, and a condition of different-size originals included in a wad of originals is that a width-direction size is one rank different in size than a specified size.

8. The paper feed apparatus according to claim 5, wherein an increase of the load pressure is within a range of three to ten times a load pressure prior to increasing the load pressure.

9. The paper feed apparatus according to claim 1, wherein the original placement tray is constructed such that originals are placed on a center reference in a tray-width direction, and the pickup roller is constructed so as to be arranged in opposition to the center reference position.

10. The paper feed apparatus according to claim 5, wherein the original placement tray is constructed such that originals are placed on a center reference in a tray-width direction, and the pickup roller is constructed so as to be arranged in opposition to the center reference position.

11. The paper feed apparatus according to claim 1, further comprising a separation roller connected to the support shaft so that the support shaft is located between the pickup roller and the separation roller, wherein the support shaft connects the pickup roller to the separation roller, and the pressure varying mechanism applies downward pressure on the support shaft at a location between the pickup roller and the separation roller so that the pickup roller applies downward pressure on the originals.

12. The paper feed apparatus according to claim 11, wherein the pressing unit contacts and presses against the support shaft at a location between the pickup roller and the separation roller.

* * * * *

UNITED STATES PATENT AND TRADEMARK OFFICE

CERTIFICATE OF CORRECTION

PATENT NO. : 8,002,267 B2
APPLICATION NO. : 11/517446
DATED : August 23, 2011
INVENTOR(S) : Hirotoshi Iemura et al.

It is certified that error appears in the above-identified patent and that said Letters Patent is hereby corrected as shown below:

IN THE CLAIMS:

In claim 1, at column 10, line 37, change “pressing portion” to --pressing unit--.

Signed and Sealed this
Twenty-ninth Day of November, 2011

David J. Kappos

David J. Kappos
*Director of the United States Patent and Trademark Office*